US008690314B2

(12) United States Patent
Castells De Monet et al.

(10) Patent No.: US 8,690,314 B2
(45) Date of Patent: Apr. 8, 2014

(54) TRANSPORT MEDIA BY APPLICATION OF NOMINAL TENSION AND ENHANCED TENSION THERETO

(75) Inventors: Raimon Castells De Monet, Barcelona (ES); Daniel Gutiérrez Garcia, Barcelona (ES); Xavier Domingo Reguant, Barcelona (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 158 days.

(21) Appl. No.: 13/362,266

(22) Filed: Jan. 31, 2012

(65) Prior Publication Data

US 2013/0194368 A1 Aug. 1, 2013

(51) Int. Cl.
*B41J 2/01* (2006.01)

(52) U.S. Cl.
USPC ..... 347/104; 347/101

(58) Field of Classification Search
CPC ..... B41J 11/007; B41J 11/42; B41J 29/393
USPC ..... 347/16, 19, 104, 101
See application file for complete search history.

(56) References Cited

U.S. PATENT DOCUMENTS

| | | | | |
|---|---|---|---|---|
| 4,804,979 | A * | 2/1989 | Kamas et al. | 347/116 |
| 2009/0283565 | A1 | 11/2009 | Ibanez et al. | |
| 2011/0199417 | A1 * | 8/2011 | Naoi et al. | 347/16 |
| 2012/0062641 | A1 * | 3/2012 | DeJong et al. | 347/19 |

* cited by examiner

*Primary Examiner* — Julian Huffman
*Assistant Examiner* — Sharon A Polk

(57) ABSTRACT

A media transport method includes applying a nominal tension to a media extending between and in contact with a media drive roller of a drive roller assembly and a media output roller of an output roller assembly by the media output roller. The media transport method also includes advancing the media toward and away from a media support member disposed between the media drive roller and the media output roller and in contact with the media by the media drive roller. The media transport method also includes determining whether the media drive roller is in a rotating state within a predetermined time period after being in a non-rotating state by a restart period determination module and a kinematic condition exists corresponding to a non-synchronized state between rotation of the media drive roller and the media output roller by a kinetic condition determination module.

20 Claims, 6 Drawing Sheets

TRANSPORT MEDIA BY APPLICATION OF NOMINAL TENSION AND ENHANCED TENSION THERETO

BACKGROUND

Media transport apparatuses transport media along a media transport path. Image forming apparatuses such as large-format printing systems may include media transport apparatuses and be supplied with the media in a form of media supply rolls. In such large format printing systems, the media is transported along the media transport path from the media supply roll to a print region. In the print region, images may be formed on the media.

BRIEF DESCRIPTION OF THE DRAWINGS

Non-limiting examples of the present disclosure are described in the following description, read with reference to the figures attached hereto and do not limit the scope of the claims. In the figures, identical and similar structures, elements or parts thereof that appear in more than one figure are generally labeled with the same or similar references in the figures in which they appear. Dimensions of components and features illustrated in the figures are chosen primarily for convenience and clarity of presentation and are not necessarily to scale. Referring to the attached figures:

DETAILED DESCRIPTION

Figure 1:
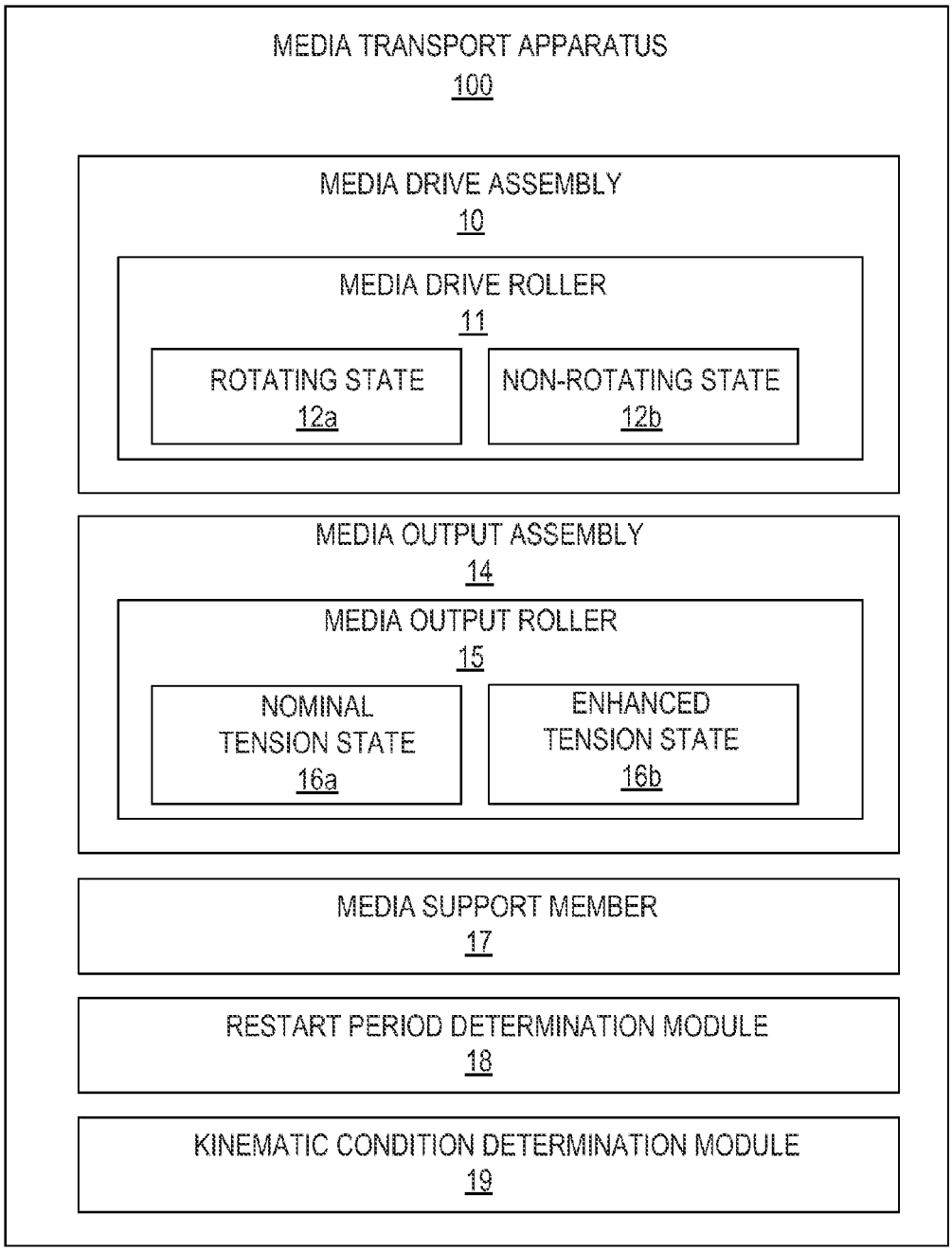
FIG. 1 is a block diagram illustrating a media transport apparatus according to an example.

In the following detailed description, reference is made to the accompanying drawings which form a part hereof, and in which is detected by way of illustration specific examples in which the present disclosure may be practiced. It is to be understood that other examples may be utilized and structural or logical changes may be made without departing from the scope of the present disclosure. The following detailed description, therefore, is not to be taken in a limiting sense, and the scope of the present disclosure is defined by the appended claims.

Media transport apparatuses transport media along a media transport path. The media may be supported by a media support member and span between a media drive roller and a media output roller. The media drive roller may incrementally advance the media. The media output roller may receive the media after passing the media support member. The media support member may support and contact the media. For example, in an image forming system, the media support member such as a platen may contact the media in a print region such that the media may selectively receive images thereon by a fluid applicator unit. Tension may be applied to the media spanning between the media drive roller and the media output roller. Periodically, however, slacking events may occur in which the media may slack and the tension previously applied to the media may be eliminated for a period of time. For example, during the incremental advancement of the media in discrete intervals, the friction cause by the media support member against the media may result in a stick-slip condition. That is, the media upstream from the media support member may buckle and/or wrinkle due to the friction between the media support member and the media during an initial time period in which media advancement is initiated (e.g., restart period). The stick-slip condition is a transient state that may occur during a short period of time of the initial rotational movement of the media drive roller. Such slacking events may result in media transport failure, image forming system failure and/or printing defects.

In examples, a media transport apparatus includes, amongst other things, a media drive roller having a rotating state and a non-rotating state, a media output roller, a restart period determination module, a kinematic condition determination module, and an output servomechanism coupled to the media output roller. The restart period determination module may determine whether the media drive roller is in the rotating state within a predetermined time period after being in the non-rotating state. The kinematic condition determination module may determine whether a kinematic condition exists corresponding to a non-synchronization state between rotation of the media drive roller and the media output roller. The output servomechanism may place the media output roller in one of the nominal tension state and the enhanced tension state based on the respective determinations by the restart period determination module and the kinematic condition determination module. Accordingly, media transport failure, image forming system failure and/or printing defects may be reduced.

FIG. 1 is a block diagram illustrating a media transport apparatus according to an example. Referring to FIG. 1, in some examples, a media transport apparatus 100 includes a media drive assembly 10 including a media drive roller 11 having a rotating state 12*a* to move media along a media transport path in a media transport direction and a non-rotating state 12*b*, a media output assembly 14 including a media output roller 15 to receive the media from the media drive roller 11 transported along the media transport path, a media support member 17 disposed between the media drive roller 11 and the media output roller 15 to support and contact the media, a restart period determination module 18, and a kinematic condition determination module 19. The media output roller 15 may include a nominal tension state 16*a* to apply a nominal tension to the media and an enhanced tension state 16*b* to apply an enhanced tension to the media. The enhanced tension corresponds to a predetermined amount of tension greater than the nominal tension. For example, the rotational speed of the media output roller 15 may increase relative to the rotational speed of the media drive roller 11 to increase tension applied to the media.

Referring to FIG. 1, in some examples, the restart period determination module 18 may determine whether the media drive roller 11 is in the rotating state 12*a* within a predetermined time period after being in the non-rotating state 12*b*. For example, in the rotating state 12*a*, the media drive roller 11 rotates about a longitudinal axis thereof. In the non-rotating state 12*b*, the media drive roller 11 does not rotate about the longitudinal axis thereof. The kinematic condition determination module 19 may determine whether a kinematic condition exists corresponding to a non-synchronization state between rotation of the media drive roller 11 and the media output roller 15. In some examples, the restart period determination module 18 and/or the kinematic condition determination module 19 may be implemented in hardware, software, or a combination of hardware and software. Accordingly, the restart period determination module 18 and/or the kinematic condition determination module 19 may be implemented, in part, as a computer program stored in the media transport apparatus locally such as in firmware or remotely, for example, in a server or a host computing device considered herein to be part of the media transport apparatus 100.

Figure 2:
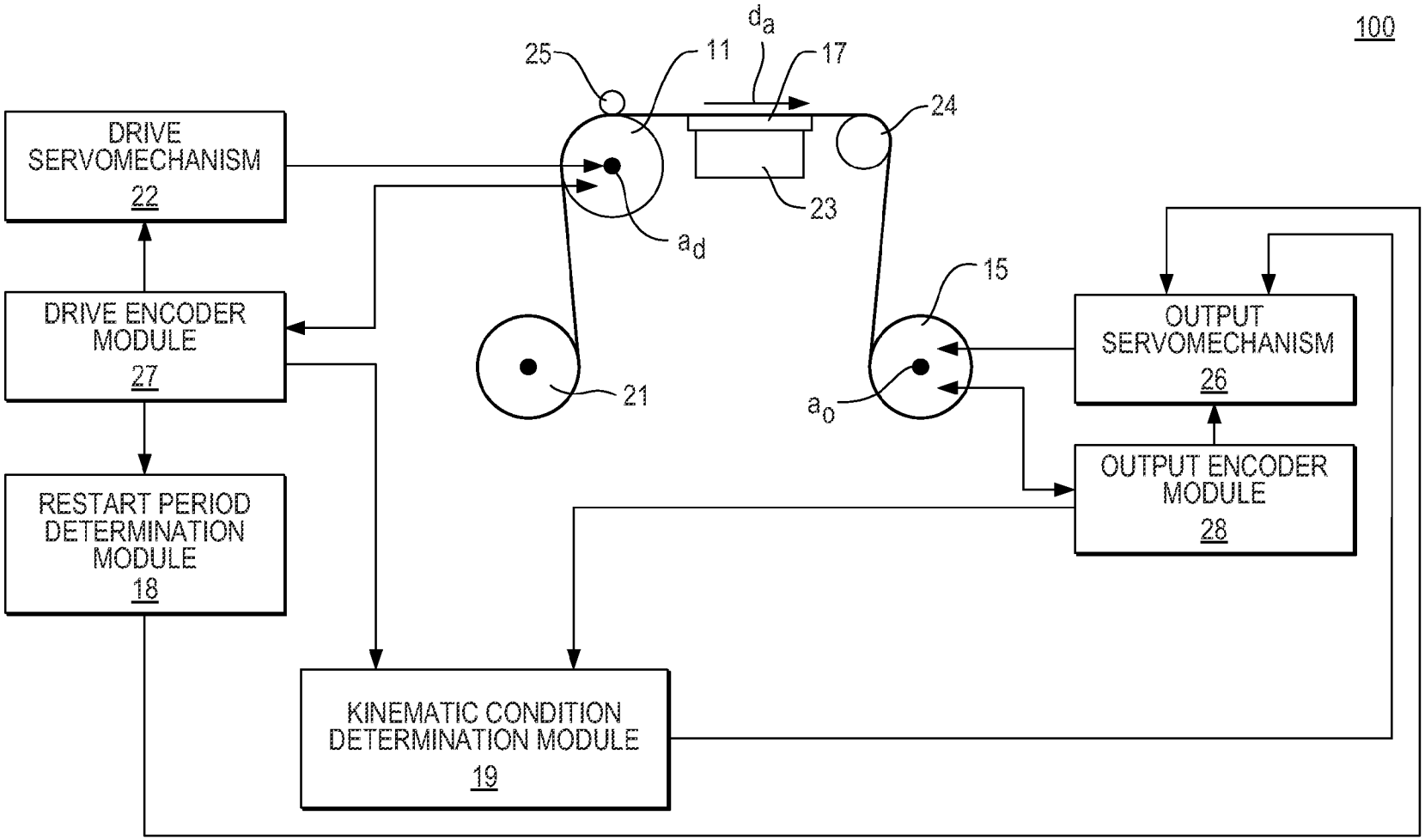
FIG. 2 is a schematic view illustrating a media transport apparatus according to an example.

FIG. 2 is a schematic view illustrating a media transport apparatus according to an example. Referring to FIG. 2, in some examples, the media transport apparatus 100 may also include a media supply roller 21, a diverter roller 24 disposed between the media support member 17 and the media output roller 15, a pressure roller 25, and a vacuum unit 23. The media supply roller 21 may supply the media in a form of a media supply roll to the media drive roller 11. The diverter roller 24 may guide the media to the media output roller 15. The pressure roller 25 may be disposed opposite the media drive roller 11 to form a nip therewith to advance the media in a media advancement direction $d_a$ toward the media support member 17 along the media transport path. The vacuum unit 23 may be disposed opposite the media support member 17 to selectively apply pressure to position the media against the media support member 17. That is, the vacuum unit 23 may selectively apply suction to suck the media against the media support member 23. For example, the vacuum unit 23 may position the media against the media support member 17 in a print region for the media to be printed on by a fluid applicator unit.

Referring to FIGS. 1 and 2, in some examples, the media output assembly 14 may also include an output servomechanism 26 coupled to the media output roller 15 and an output encoder module 28. The output servomechanism 26 may communicate with the restart period determination module 18, the kinematic condition determination module 19, the output encoder module 28, and the media output roller 15. That is, the output servomechanism 26 may place the media output roller 15 in one of the nominal tension state 16*a* and the enhanced tension state 16*b* based on the respective determinations by the restart period determination module 18 and the kinematic condition determination module 19. For example, the output servomechanism 26 may place the media output roller 15 in the enhanced tension state 16*b* in response to the determination that the media drive roller 11 is in the rotating state 12*a* within the predetermined time period after being in the non-rotating state 12*b* by the restart period determination module 18 and the determination that the kinematic condition exists by the kinematic condition determination module 19. The media output roller 15 may rotate about a longitudinal axis $a_o$ thereof.

Additionally, the output servomechanism 26 may place the media output roller 15 in the nominal tension state 16*a* in response to at least one of the determination that the media drive roller 11 is not in the rotating state 12*a* within the predetermined time period after being in the non-rotating state 12*b* by the restart period determination module 18 and the determination that the kinematic condition does not exist by the kinematic condition determination module 19. In some examples, the media drive assembly 10 may also include a drive servomechanism 22 coupled to the media drive roller 11 and a drive encoder module 27. The drive servomechanism 22 may control the media drive roller 11. For example, the drive servomechanism 22 may control the positioning of the media drive roller 11 to minimize error between real movement and a predetermined speed profile. In some examples, the drive servomechanism 22 may include an actuator (not illustrated) having a transmission coupled to the media drive roller 11. This actuator may be controlled by a position servo control closed loop for precise positioning of the media drive roller 11. Close loop position may be provided by the encoder module 27 and the servo control may try to minimize the error between the real movement and a predetermined speed profile of the media drive roller 11 by modifying power delivered to the actuator during the movement of the media drive roller 11. The media drive roller 11 may rotate about a longitudinal axis $a_d$.

Figure 3A:
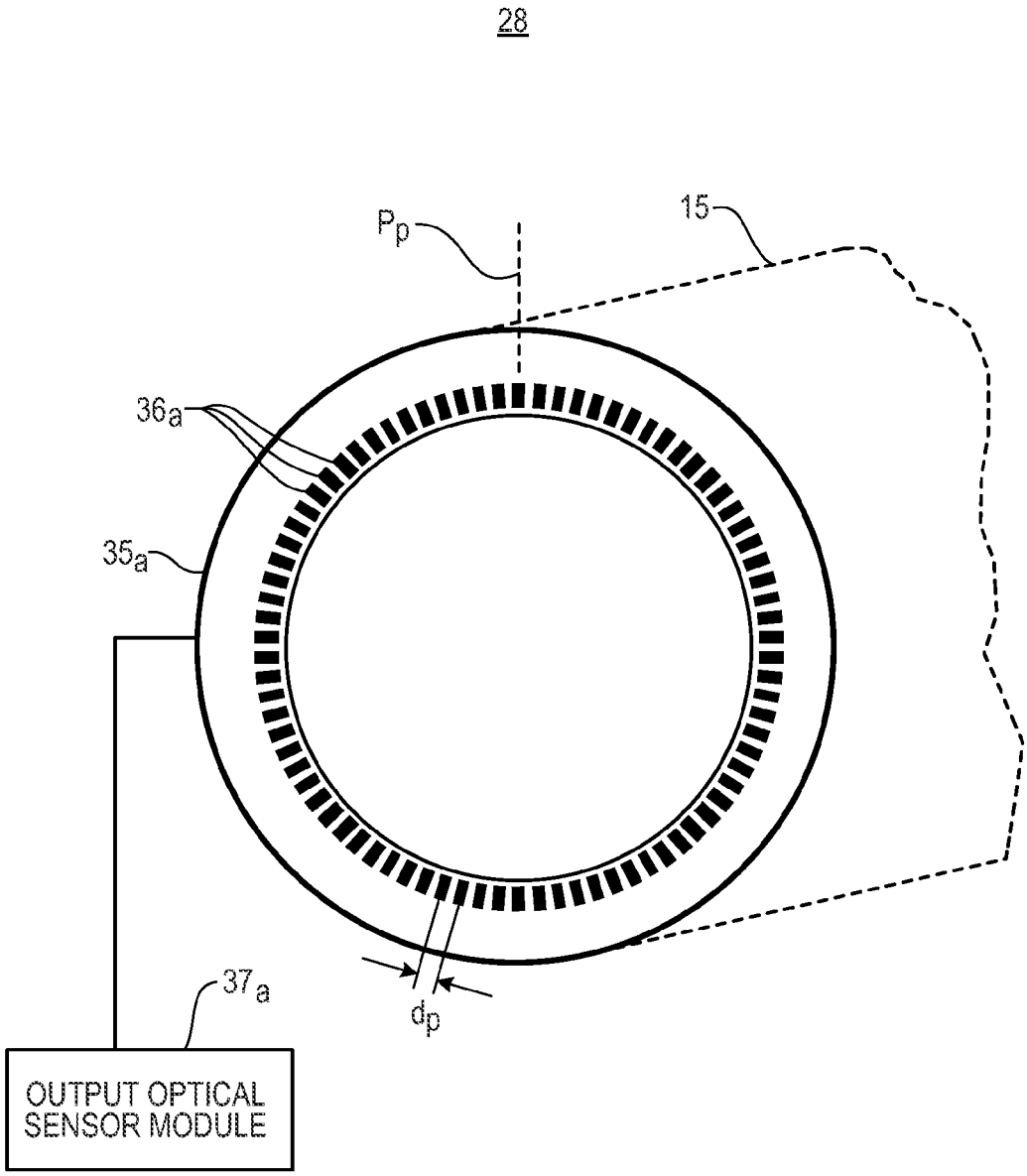
FIG. 3A is a schematic view illustrating an output encoder module of the media transport apparatus of FIG. 2 according to an example.

FIG. 3A is a schematic view illustrating an output encoder module of the media transport apparatus of FIG. 2 according to an example. Referring to FIG. 3A, in some examples, an output encoder module 28 may correspond to the media output roller 15. The output encoder module 28 may determine at least one of a rotational advancement position and rotational speed of the media output roller 15 based on a rotation thereof. The output encoder module 28 may also include an output encoder wheel 35*a* coupled to the media output roller 15 and an output optical sensor module 37*a*. The output encoder wheel 35*a* may include a number of encoder units 36*a* spaced apart from each other by a predetermined distance $d_p$. The output optical sensor module 37*a* may detect a number of encoder units 36*a* that move past a predetermined point $p_p$ over a period of time in response to rotation of the output encoder wheel 35*a*. The encoder units 36*a*, for example, may be in a form of division marks. The output optical sensor module 37*a* may detect a number of encoder units 36*a* that move past a predetermined point $p_p$ over a period of time in response to a rotation of the output encoder wheel 35*a*. For example, the output optical sensor module 37*a* may have a line of sight and/or detection region corresponding with the predetermined point $p_p$ and count the number of encoder units 36*a* from an initial encoder unit to a final encoder unit that move past the predetermined point $p_p$.

Figure 3B:
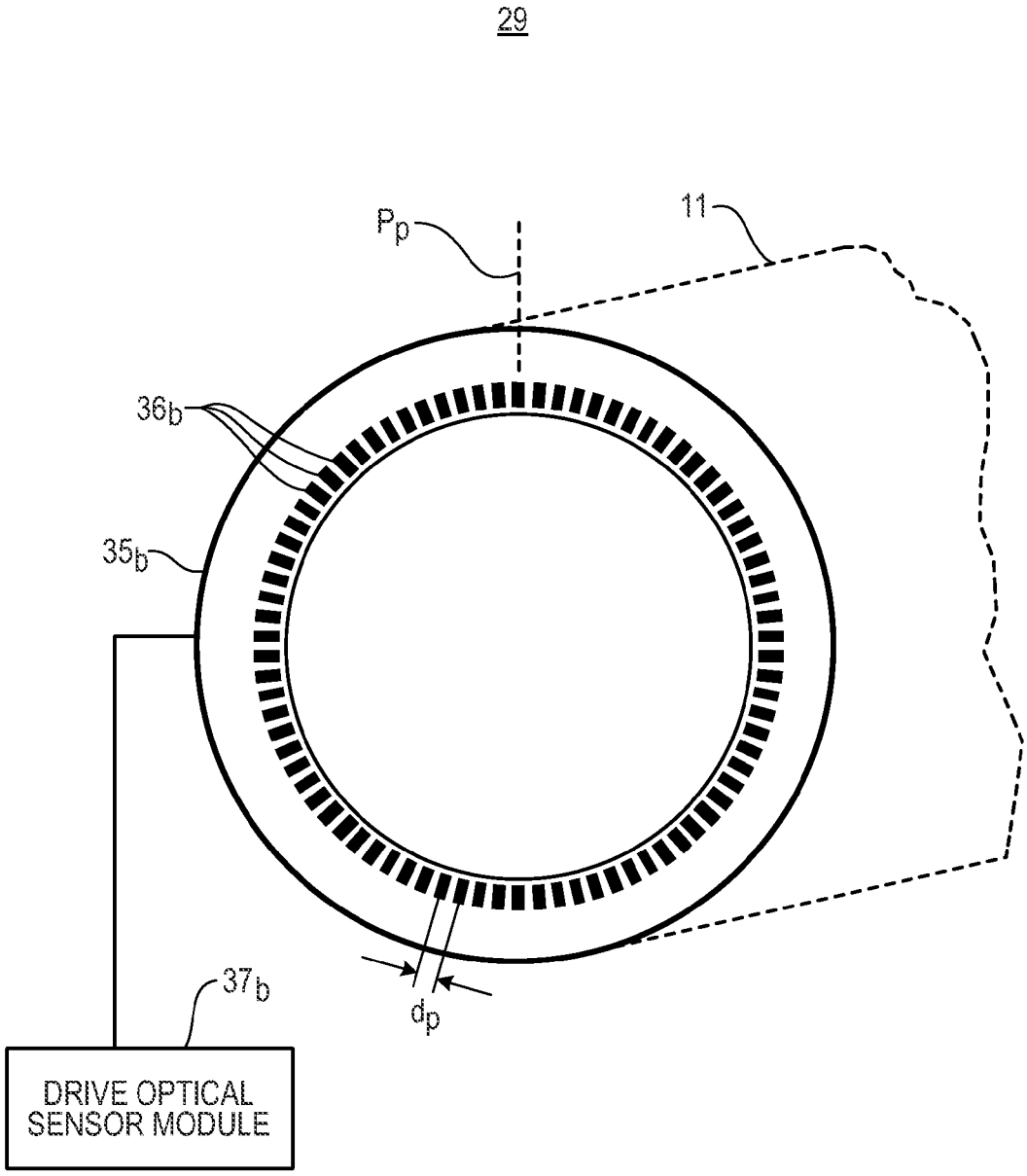
FIG. 3B is a schematic view illustrating a drive encoder module of the media transport apparatus of FIG. 2 according to an example.

FIG. 3B is a schematic view illustrating a drive encoder module of the media transport apparatus of FIG. 2 according to an example. Referring to FIG. 3B, in some examples, a drive encoder module 27 may correspond to the media drive roller 11. The drive encoder module 27 may determine at least one of a rotational advancement position and rotational speed of the media drive roller 11 based on a rotation thereof. For example, the drive encoder module 11 may also include a drive encoder wheel 35*b* coupled to the media drive roller 11 and a drive optical sensor module 37*b*. The drive encoder wheel 35*b* may include a number of encoder units 36*b* spaced apart from each other by a predetermined distance $d_p$. The encoder units 36*b*, for example, may be in a form of division marks. The drive optical sensor module 37*b* may detect a number of encoder units 36*b* that move past a predetermined point $p_p$ over a period of time in response to a rotation of the drive encoder wheel 35*b*. For example, the drive optical sensor module 37*b* may have a line of sight and/or detection region corresponding with the predetermined point $p_p$ and count the number of encoder units 36*b* from an initial encoder unit to a final encoder unit that move past the predetermined point $p_p$.

Figure 4:
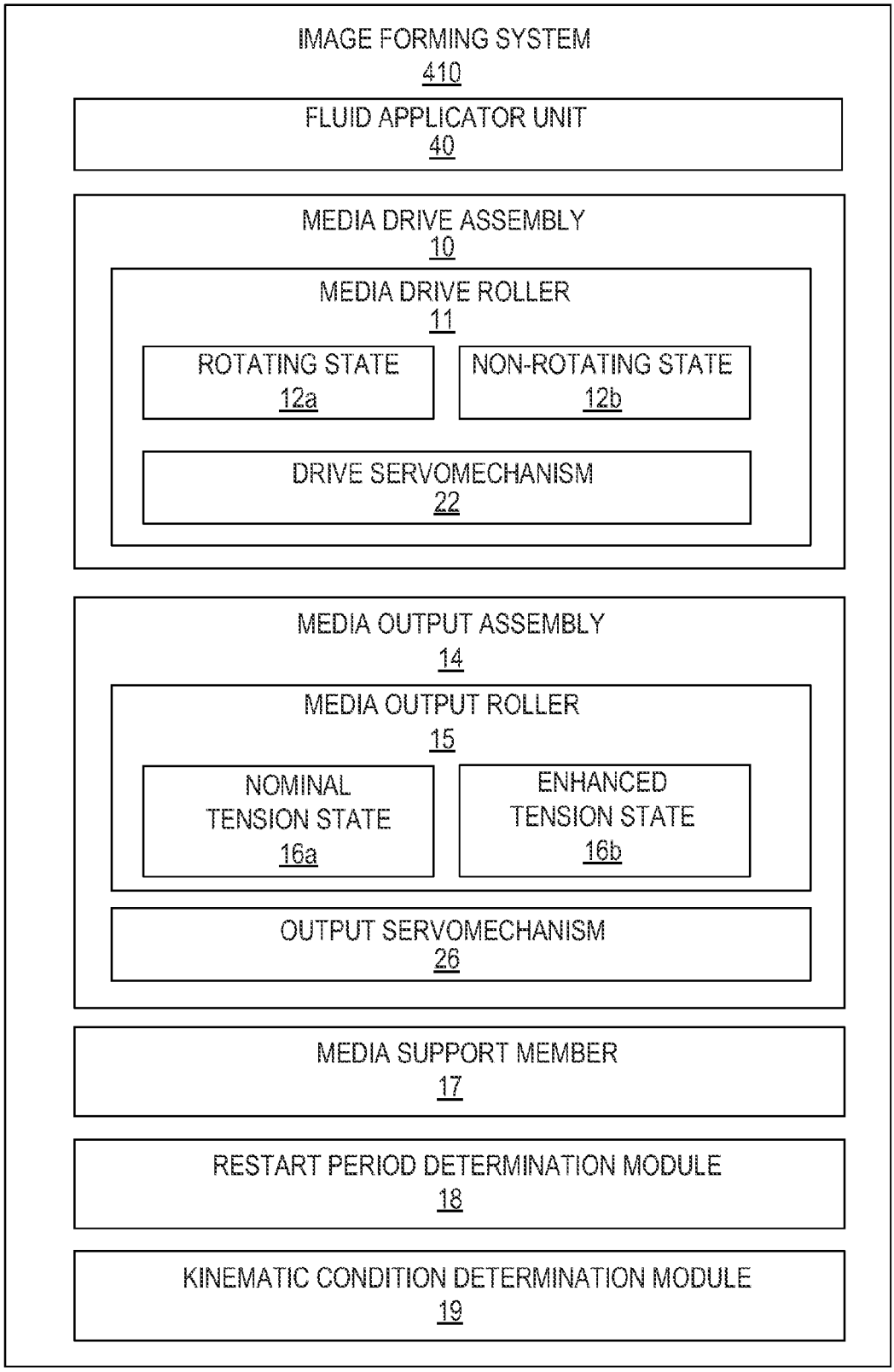
FIG. 4 is a block diagram illustrating an image forming system according to an example.

FIG. 4 is a block diagram illustrating an image forming system according to an example. Referring to FIG. 4, in some examples, an image forming system 410 includes a fluid applicator unit 40, a media drive assembly 10, a media output assembly 14, a media support member 17, a restart period determination module 18, and a kinematic condition determination module 19. The media drive assembly 10 may include a media drive roller 11 and a drive servomechanism 22 coupled to the media driver roller 11. The media output assembly 14 may include a media output roller 15 to receive the media from the media drive roller 11 transported along the media transport path and an output servomechanism 26 coupled to the media output roller 15. In some examples, the image forming system 410 may include a large-format printer.

Referring to FIG. 4, in some examples, the fluid applicator unit 40 may selectively apply fluid to the media. In some examples, the fluid applicator unit 20 may be an inkjet printhead and the fluid may be ink. The media drive roller 11 may include a rotating state 12*a* to move the media along a media transport path in a media transport direction and a non-rotating state 12*b*. For example, in the rotating state 12*a*, the media drive roller 11 rotates about a longitudinal axis thereof. In the non-rotating state 12*b*, the media drive roller 11 does not rotate about the longitudinal axis thereof. The media output roller 15 may have a nominal tension state 16*a* to apply a nominal tension to the media and an enhanced tension state 16*b* to apply an enhanced tension to the media. The enhanced tension may correspond to a predetermined amount of tension greater than the nominal tension. For example, the rotational speed of the media output roller 15 may increase relative to the rotational speed of the media drive roller 11 to increase tension applied to the media. The media support member 17 may be disposed between the media drive roller 11 and the media output roller 15 to support and contact the media.

Referring to FIG. 4, in some examples, the restart period determination module 18 may determine whether the media drive roller 11 is in the rotating state 12*a* within a predetermined time period after being in the non-rotating state 12*b*. The kinematic condition determination module 19 may determine whether a kinematic condition exists corresponding to a non-synchronization state between rotation of the media drive roller 11 and the media output roller 15. The output servomechanism 26 may place the media output roller 15 in one of the nominal tension state 16*a* and the enhanced tension state 16*b* based on the respective determinations by the restart period determination module 18 and the kinematic condition determination module 19.

Figure 5:
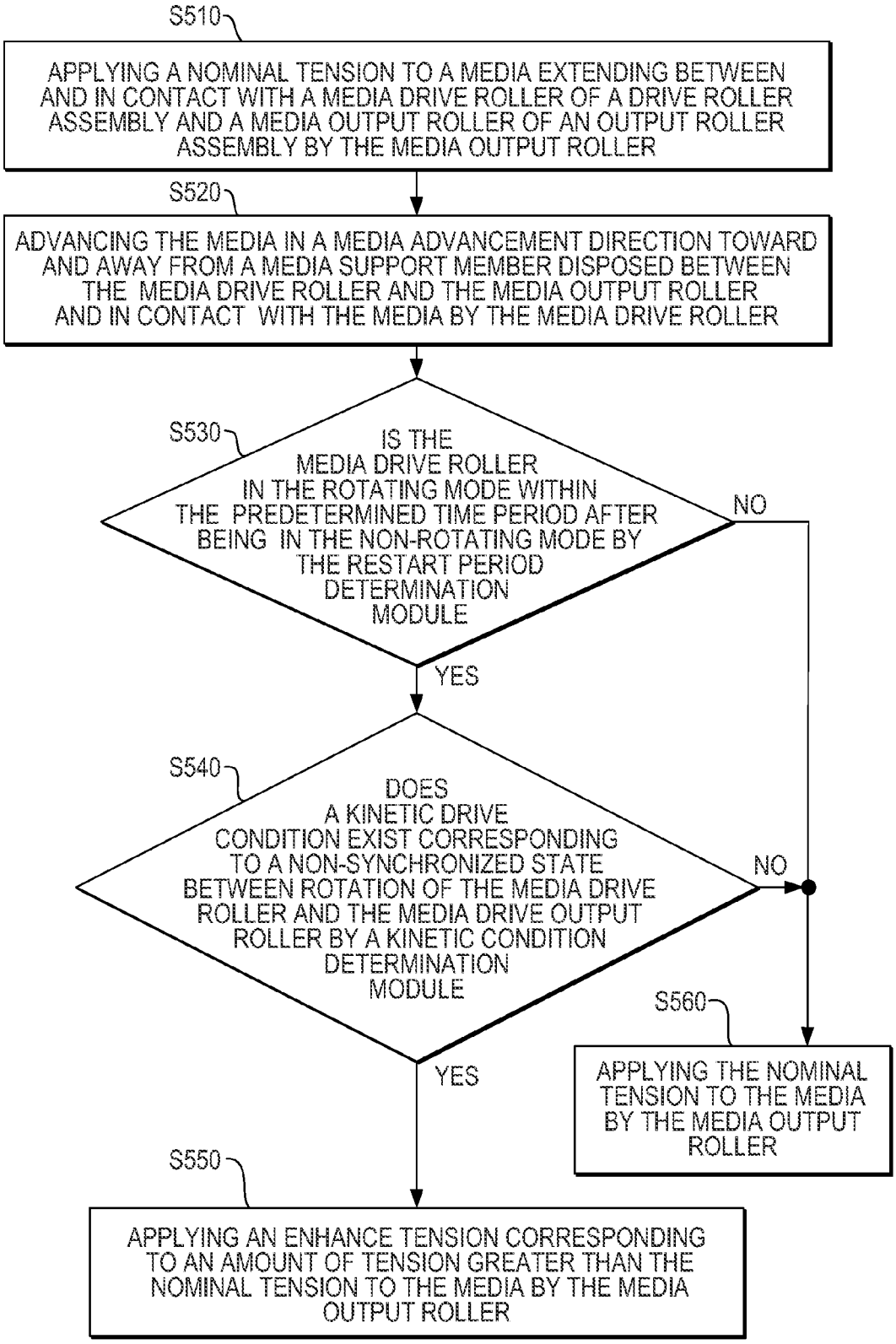
FIG. 5 is a flowchart illustrating a media transport method according to an example.

FIG. 5 is a flowchart illustrating a media transport method according to an example. Referring to FIG. 5, in block S510, a nominal tension is applied to a media extending between and in contact with a media drive roller of a drive roller assembly and a media output roller of an output roller assembly by the media output roller. In block S520, the media is advanced in a media advancement direction toward and away from a media support member disposed between the media drive roller and the media output roller and in contact with the media by the media drive roller. In block S530, whether the media drive roller is in a rotating state within a predetermined time period after being in a non-rotating state is determined by a restart period determination module. For example, a start of rotation of the media drive roller may be identified, an amount of time that expires after the start of rotation of the media drive roller may be calculated to obtain a restart time period, the restart time period may be compared with the predetermined time period, and whether the restart time period is less than the predetermined time period may be determined. In some examples, the predetermined time period is about 0.2 seconds.

In block S540, whether a kinematic condition exists corresponding to a non-synchronized state between rotation of the media drive roller and the media output roller is determined by a kinetic condition determination module. In some examples, the kinematic condition may include at least one of a rotational speed of the media output roller being less than a predetermined output speed, a rotational advancement position of the media drive roller being greater by a predetermined position amount than a rotational advancement position of the media output roller, and a rotational speed of the media drive roller being less than a predetermined drive speed. For example, determining whether a rotational speed of the media output roller is less than a predetermined output speed may include identifying the rotational speed of the media output roller, subtracting the predetermined output speed from the rotational speed of the media output roller to obtain a speed differential value, and determining whether the speed differential value is less than zero.

Additionally, determining whether a rotational advancement position of the media drive roller is greater by a predetermined position amount than a rotational advancement position of the media output roller may include identifying the rotational advancement position of the media drive roller, identifying the rotational advancement position of the media output roller, subtracting the rotational advancement position of the media output roller from the rotational advancement position of the media drive roller to obtain a position differential value, and determining whether the position differential value is greater than a predetermined position amount. Additionally, determining whether a rotational speed of the media drive roller is less than a predetermined drive speed may include identifying the rotational speed of the media drive roller, subtracting the predetermined drive speed from the rotational speed of the media drive roller to obtain a drive speed differential value, and determining whether the drive speed differential value is less than zero.

In block S550, if the media drive roller is in the rotating state within the predetermined time period after being in the non-rotating state and the kinematic condition exists, an enhanced tension corresponding to an amount of tension greater than the nominal tension is applied to the media by the media output roller. In some examples, the enhanced tension may be about one hundred and twenty percent of the nominal tension. In block S560, if at least one of the media drive roller is not in the rotating state within the predetermined time period after being in the non-rotating state and the kinematic condition does not exist, the nominal tension is applied to the media by the media output roller. In some examples, the media transport method may also include subsequently applying the nominal tension to the media by the media output roller in response to an elimination of the kinematic condition by the previously applying the enhanced tension to the media by the media output roller.

In some examples, determining whether the media drive roller is in a rotating state within a predetermined time period after being in a non-rotating state by a restart period determination module and a kinematic condition exists by a kinetic condition determination module may include determining whether the media drive roller is in the rotating state within the predetermined time period after being in the non-rotating state by the restart period determination module. That is, in response to the determination that the media drive roller is not in the rotating state within the predetermined time period after being in the non-rotating state, the nominal tension is applied by the media output roller. Additionally, in response to a determination that the media drive roller is in the rotating state within the predetermined time period after being in the non-rotating state, a determination is made as to whether the predetermined kinematic condition exists. That is, in response to a determination that the kinematic condition does not exist, the nominal tension is applied to the media by the media output roller. Also, in response to the determination that the kinematic condition does exist, the enhanced tension is applied to the media by the media output roller.

It is to be understood that the flowchart of FIG. 5 illustrates architecture, functionality, and/or operation of an example of the present disclosure. If embodied in software, each block may represent a module, segment, or portion of code that includes one or more executable instructions to implement the specified logical function(s). If embodied in hardware, each block may represent a circuit or a number of interconnected circuits to implement the specified logical function(s). Although the flowchart of FIG. 5 illustrates a specific order of execution, the order of execution may differ from that which is depicted. For example, the order of execution of two or more blocks may be scrambled relative to the order illustrated. Also, two or more blocks illustrated in succession in FIG. 5 may be executed concurrently or with partial concurrence. All such variations are within the scope of the present disclosure.

The present disclosure has been described using non-limiting detailed descriptions of examples thereof. Such examples are not intended to limit the scope of the present disclosure. It should be understood that features and/or operations described with respect to one example may be used with other examples and that not all examples of the present disclosure have all of the features and/or operations illustrated in a particular figure or described with respect to one of the examples. Variations of examples described will occur to persons of the art. Furthermore, the terms "comprise," "include," "have" and their conjugates, shall mean, when used in the present disclosure and/or claims, "including but not necessarily limited to."

It is noted that some of the above described examples may describe examples contemplated by the inventors and therefore may include structure, acts or details of structures and acts that may not be essential to the present disclosure and which are described as examples. Structure and acts described herein are replaceable by equivalents, which perform the same function, even if the structure or acts are different, as known in the art. Therefore, the scope of the present disclosure is limited only by the elements and limitations as used in the claims.

What is claimed is:

1. A media transport method, comprising:

applying a nominal tension to a media extending between and in contact with a media drive roller of a drive roller assembly and a media output roller of an output roller assembly by the media output roller;

advancing the media in a media advancement direction toward and away from a media support member disposed between the media drive roller and the media output roller and in contact with the media by the media drive roller; and determining whether the media drive roller is in a rotating state within a predetermined time period after being in a non-rotating state by a restart period determination module and a kinematic condition exists corresponding to a non-synchronized state between rotation of the media drive roller and the media output roller by a kinetic condition determination module such that:

if so, applying an enhanced tension corresponding to an amount of tension greater than the nominal tension to the media by the media output roller; and if not, applying the nominal tension to the media by the media output roller.

2. The media transport method according to claim 1, wherein the determining whether the media drive roller is in a rotating state within a predetermined time period after being in a non-rotating state by a restart period determination module and a kinematic condition exists by a kinetic condition determination module further comprises:

determining whether the media drive roller is in the rotating state within the predetermined time period after being in the non-rotating state by the restart period determination module such that:

in response to the determination that the media drive roller is not in the rotating state within the predetermined time period after being in the non-rotating state, applying the nominal tension by the media output roller; and in response to a determination that the media drive roller is in the rotating state within the predetermined time period after being in the non-rotating state, determining whether the predetermined kinematic condition exists such that:

in response to a determination that the kinematic condition does not exist, applying the nominal tension to the media by the media output roller; and in response to the determination that the kinematic condition does exist, applying the enhanced tension to the media by the media output roller.

3. The media transport method according to claim 2, further comprising:

subsequently applying the nominal tension to the media by the media output roller in response to an elimination of the kinematic condition by the previously applying the enhanced tension to the media by the media output roller.

4. The media transport method according to claim 2, wherein the enhanced tension is about one hundred and twenty percent of the nominal tension.

5. The media transport method according to claim 1, wherein the predetermined time period is 0.2 seconds.

6. The media transport method according to claim 1, wherein the determining whether the media drive roller is in the rotating state within the predetermined time period after being in the non-rotating state by a restart period determination module further comprises:

identifying a start of rotation of the media drive roller;

calculating an amount of time that expires after the start of rotation of the media drive roller to obtain a restart time period; and comparing the restart time period with a predetermined time period; and determining whether the restart time period is less than the predetermined time period.

7. The media transport method according to claim 1, wherein the kinematic condition further comprises at least one of a rotational speed of the media output roller is less than a predetermined output speed, a rotational advancement position of the media drive roller is greater by a predetermined position amount than a rotational advancement position of the media output roller, and a rotational speed of the media drive roller is less than a predetermined drive speed.

8. The media transport method according to claim 7, wherein the determining whether the kinematic condition exists by the kinematic condition determination module further comprises:

identifying a rotational speed of the media output roller;

subtracting a predetermined output speed from the rotational speed of the media output roller to obtain a speed differential value; and determining whether the speed differential value is less than zero.

9. The media transport method according to claim 7, wherein the determining whether the kinematic condition exists by the kinematic condition determination module further comprises:

identifying a rotational advancement position of the media drive roller;

identifying a rotational advancement position of the media output roller;

subtracting the rotational advancement position of the media output roller from the rotational advancement position of the media drive roller to obtain a position differential value; and determining whether the position differential value is greater than a predetermined position amount.

10. The media transport method according to claim 7, wherein the determining whether the kinematic condition exists by the kinematic condition determination module further comprises:

identifying a rotational speed of the media drive roller;

subtracting the predetermined drive speed from the rotational speed of the media drive roller to obtain a drive speed differential value; and determining whether the drive speed differential value is less than zero.

11. A media transport apparatus, comprising:

a media drive assembly including a media drive roller having a rotating state to move media along a media transport path in a media transport direction and a non-rotating state;

a media output assembly including a media output roller to receive the media from the media drive roller transported along the media transport path, the media output roller having a nominal tension state to apply a nominal tension to the media and an enhanced tension state to apply an enhanced tension corresponding to a predetermined amount of tension greater than the nominal tension to the media;

a media support member disposed between the media drive roller and the media output roller to support and contact the media;

a restart period determination module to determine whether the media drive roller is in the rotating state within a predetermined time period after being in the non-rotating state;

a kinematic condition determination module to determine whether a kinematic condition exists corresponding to a non-synchronization state between rotation of the media drive roller and the media output roller;

the media output roller to apply the enhanced tension to the media in response to the media drive roller being in the rotating state within the predetermined time period after being in the non-rotating state and the kinematic condition existing; and the media output roller to apply the nominal tension to the media in response to at least one of the media drive roller not being in the rotating state within the predetermined time period after being in the non-rotating state and the kinematic condition not existing.

12. The media transport apparatus according to claim 11, wherein the media output assembly further comprises:

an output servomechanism coupled to the media output roller, the output servomechanism to place the media output roller in one of the nominal tension state and the enhanced tension state based on the respective determinations by the restart period determination module and the kinematic condition determination module.

13. The media transport apparatus according to claim 12, wherein the output servomechanism is configured to place the media output roller in the enhanced tension state in response to the determination that the media drive roller is in the rotating state within the predetermined time period after being in the non-rotating state by the restart period determination module and the determination that the kinematic condition exists by the kinematic condition determination module.

14. The media transport apparatus according to claim 12, wherein the output servomechanism is configured to place the media output roller in the nominal tension state in response to at least one of the determination that the media drive roller is not in the rotating state within the predetermined time period after being in the non-rotating state by the restart period determination module and the determination that the kinematic condition does not exist by the kinematic condition determination module.

15. The media transport apparatus according to claim 11, wherein the media output assembly further comprises an output encoder module corresponding to the media output roller to determine at least one of a rotational advancement position and rotational speed of the media output roller based on a rotation thereof, and wherein the drive roller assembly further comprises a drive encoder module corresponding to the media drive roller to determine at least one of a rotational advancement position and rotational speed of the media drive roller based on a rotation thereof.

16. The media transport apparatus according to claim 15, wherein the output encoder module further comprises:

an output encoder wheel coupled to the media output roller, the output encoder wheel having a number of encoder units spaced apart from each other by a predetermined distance; and an output optical sensor module to detect a number of encoder units that move past a predetermined point over a period of time in response to a rotation of the output encoder wheel.

17. The media transport apparatus according to claim 15, wherein the media drive assembly further comprises:

a drive servomechanism coupled to the media driver roller, the drive servomechanism to control the media drive roller.

18. The media transport apparatus according to claim 15, wherein the drive encoder module further comprises:

a drive encoder wheel coupled to the media drive roller, the drive encoder wheel having a number of encoder units spaced apart from each other by a predetermined distance; and a drive optical sensor module to detect a number of encoder units that move past a predetermined point over a period of time in response to a rotation of the drive encoder wheel.

19. The media transport apparatus according to claim 11, further comprising:

a media supply roller to supply the media in a form of a media supply roll to the media drive roller;

a diverter roller disposed between the media support member and the media output roller, the diverter roller to guide the media to the media output roller;

a pressure roller disposed opposite the media drive roller to form a nip therewith to advance the media toward the media support member along the media transport path; and a vacuum unit disposed opposite the media support member to selectively apply pressure to position the media against the media support member.

20. An image forming system, comprising:

a fluid applicator unit to selectively apply fluid to a media;

a media drive assembly including a media drive roller and a drive servomechanism coupled to the media driver roller, the media drive roller having a rotating state to move the media along a media transport path in a media transport direction and a non-rotating state;

a media output assembly including a media output roller to receive the media from the media drive roller transported along the media transport path and an output servomechanism coupled to the media output roller, the media output roller having a nominal tension state to apply a nominal tension to the media and an enhanced tension state to apply an enhanced tension corresponding to a predetermined amount of tension greater than the nominal tension to the media;

a media support member disposed between the media drive roller and the media output roller to support and contact the media;

a restart period determination module to determine whether a restart period exists corresponding to the media drive roller being in the rotating state within a predetermined time period after being in the non-rotating state; and a kinematic condition determination module to determine whether a kinematic condition exists corresponding to a non-synchronization state between rotation of the media drive roller and the media output roller;

the output servomechanism to place the media output roller in the enhanced tension state based on the restart period existing and the kinematic condition existing; and the output servomechanism to place the media output roller in the nominal tension state based on at least one of the restart period not existing and the kinematic condition not existing.

* * * * *